United States Patent [19]

Shiraki

[11] 4,072,017

[45] Feb. 7, 1978

[54] TREATING SOIL

[76] Inventor: Hisashi Shiraki, 241-31 Hirotani-cho, Fuchu, Hiroshima, Japan

[21] Appl. No.: 770,324

[22] Filed: Feb. 22, 1977

Related U.S. Application Data

[63] Continuation of Ser. No. 622,281, Oct. 10, 1975, abandoned.

[30] Foreign Application Priority Data

Oct. 11, 1974 Japan ..... 49-117565

[51] Int. Cl.[2] ..... E02D 3/12

[52] U.S. Cl. ..... 61/35; 61/50; 111/6

[58] Field of Search ..... 61/35, 36 R, 50, 63; 259/99, 100, 102; 111/6

[56] References Cited

U.S. PATENT DOCUMENTS

| | | | |
|---|---|---|---|
| 3,408,819 | 11/1968 | Delrosse | 61/7 |
| 3,800,544 | 4/1974 | Nakanishi | 61/35 |

*Primary Examiner*—Paul R. Gilliam
*Assistant Examiner*—Alex Grosz
*Attorney, Agent, or Firm*—William Anthony Drucker

[57] ABSTRACT

The present invention generally relates to a new and improved method by which colloids, clay, silt, and silt-mixed sand (hereinafter referred to as "weak soil layer") which exist in rivers, lakes, marshes, harbours, and the sea, can be easily and immediately turned into stabilized foundation ground necessary for civil construction, and particularly relates to a new and improved treatment equipment which is effective to continuously treat said weak soil layer over a height from a bottom supporting foundation, by discharging a solidifier agent of special cement which is continuously agitated by agitator impellers.

1 Claim, 14 Drawing Figures

TREATING SOIL

This is a continuation of Ser. No. 622,281 filed Oct. 10, 1975, now abandoned.

BACKGROUND OF THE INVENTION

Conventionally, in order to obtain stabilized ground necessary for civil engineering construction in rivers, lakes, marshes, harbours and the sea where said weak soil layer is at the bottom, it is necessary that said weak soil layer is removed and that sand and/or soil is put there. This requires high skill, and is difficult and time-consuming, and is accordingly costly. Moreover, there would be pollution problems in removing and treating a large amount of removed weak soil layer on land.

With those piling methods and/or sand-pile method which are generally known for use in these cases, it is extremely difficult to obtain the stabilized foundation ground necessary for civil construction by driving piles and sand-piles into a deep and wide area of said weak soil layer, and it is also impossible to put these methods in practice as the equipment and/or system necessary for carrying out said methods becomes huge in size.

OBJECTS OF THE INVENTION

An important object of the present invention is therefore to provide a treatment method by which said weak soil layer, which cannot be stabilized and treated by the conventional methods, can be effectively and efficiently treated and turned into a stabilized foundation ground necessary for civil construction.

A further important object of the present invention is to provide a treatment method by which said weak soil layer is turned into a stabilized foundation ground necessary for civil construction in a short time and at an economically low cost.

A further important object of the present invention is to provide a treatment equipment and/or apparatus which can most suitably put said method into practice in an extremely effective manner.

Other and further objects of the present invention will become obvious upon reading of the following description of the accompanying drawings, and various advantages not referred herein will occur to one skilled in the art upon employment of the invention in practice.

A preferred embodiment is shown by way of example in the accompanying drawings, and is herein described in detail. Various modifications and changes in details of construction are comprehended within the scope of the appended claims.

DESCRIPTION OF THE PREFERRED EMBODIMENT

Figure 1:
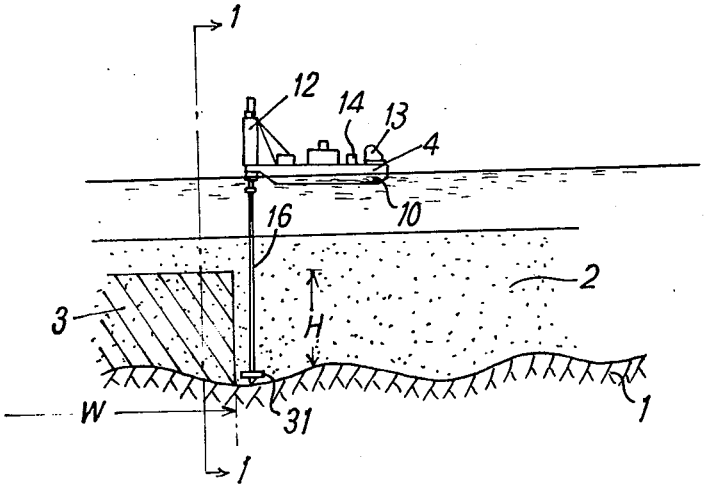
FIG. 1 is a diagrammatical vertical sectional view showing a weak soil layer being continuously treated and stabilized up to a certain necessary height from the bottom supporting foundation by a treatment equipment of the present invention.
Figure 2:
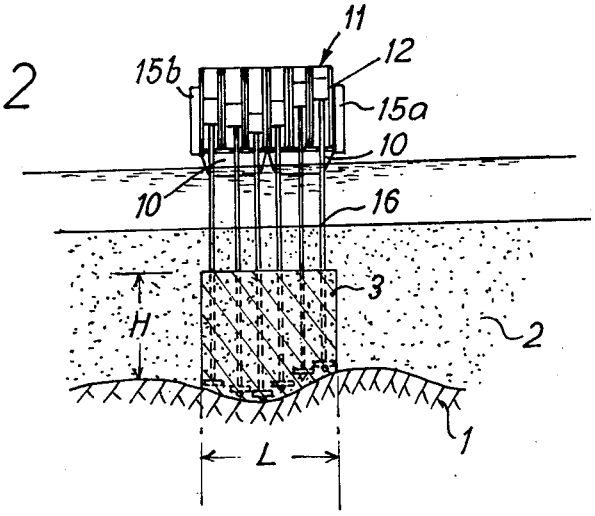
FIG. 2 is a sectional side view of FIG. 1 taken along the line I—I of FIG. 1.
Figure 3:
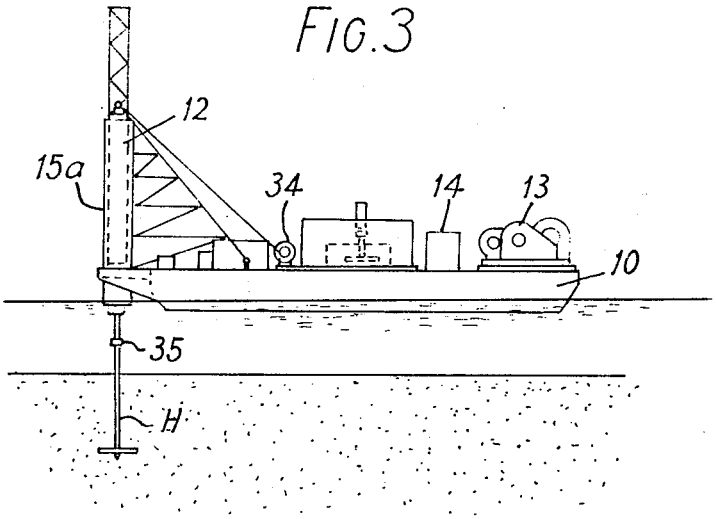
FIG. 3 is a front elevation view of a treatment equipment embodying the present invention.

FIGS. 1 and 2 show a weak soil layer 2 being continuously treated and turned into a stabilized foundation 3 up to a certain height H from a bottom supporting foundation 1 and in a certain width W. A boat is herein shown by 4. When continuously treating an stabilizing said weak soil layer 2 existing on said bottom supporting foundation 1 over a certain width, height and length, the dimensions of height H, width W and length L to be treated will be suitably determined in accordance with the area of stabilized foundation required for civil construction, and the required hardness. However, in order to turn said weak soil layer into a stabilized foundation at least necessary for civil construction, the N-value may be from 5 to 15.

Figure 6:
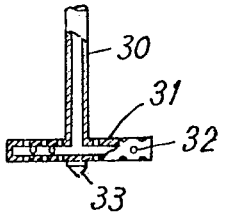
FIG. 6 is a partially diagrammatical sectional view of an agitator impeller.

The boat for treatment will now be exaplained according to the FIGS. 2 and 6. Floats of said operation boat are shown by 10. In this preferred embodiment, said operation boat is a twin-hull, on which an agitator 12 and a slurry pump 13 are provided to agitate and mix a solidifier agent conveyed from land facilities, and to distribute said solidifier agent to agitating means 11 (hereinafter described in detail). A power unit driving said agitator 12 and said slurry pump 13 is herein shown by 14.

Figure 4:
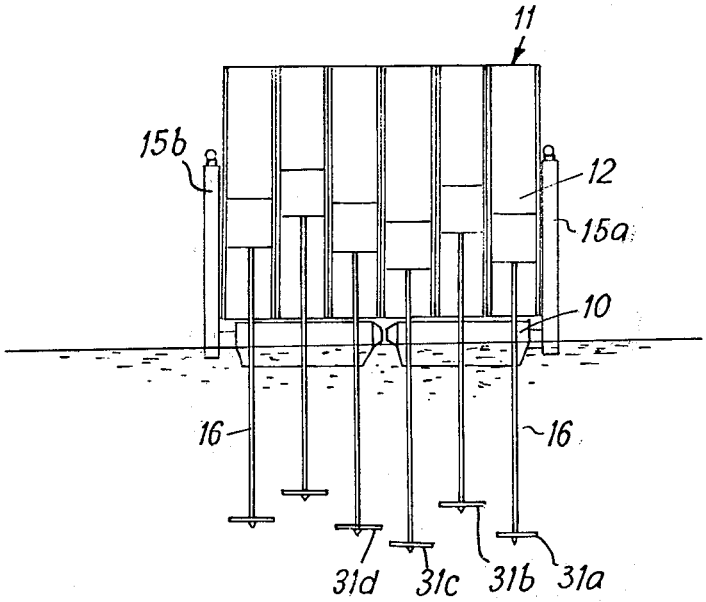
FIG. 4 is a side view of FIG. 3.
Figure 5:
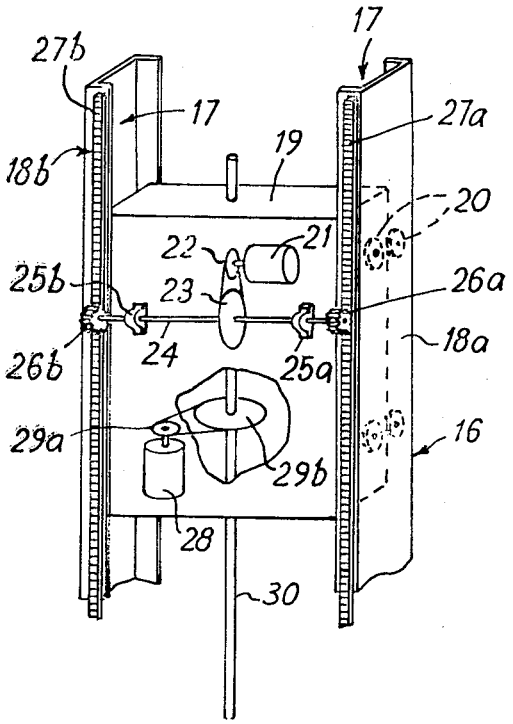
FIG. 5 is a perspective view of an elevation unit for agitator impellers constructed in accordance with the present invention.

Said agitating means 11 is supported by guide pillars **15*a* and 15*b* mounted at the rear of said operation boat 4 and is provided, as shown in FIG. 6, with several agitating units 16 which are combined in a line (six agitating units in the illustration of FIG. 4). Said agitating unit 16 has a pair of frames 18*a* and 18*b* having a U-shaped recess 17 in which a base plate 19 is elevatable. Guide rollers 20 are provided at the side face of said base plate 19 and are guided in said U-shaped recess 17. An electric motor 21 is provided at the front face of said base plate 19 and rotates a shaft 24 for elevation by way of sprockets 22 and 23. Said shaft 24, one end of which is provided with a pinion 26*a* and the other end of which is provided with a pinion 26*b*, a rotatably supported by bearings 25*a* and 25*b*. Said pinions 26*a* and 26*b* are in engagement with racks 27*a* and 27*b* which are mounted at the front of frames 18*a* and 18*b*. Another electric motor 28 is also provided at the front part of said base plate 19 and rotates an agitation shaft 30 passed through said base plate 19 by way of sprockets 29*a* and 29*b*. Said agitation shaft 30 is made hollow and, as shown in FIG. 6, has an agitator impeller 31. Said agitator impeller 31, which has many holes 32 at the circumference thereof in order to discharge a solidifier agent, is also made hollow and communicates with said hollow agitation shaft 30. Said solidifier agent is fed into the upper end of said hollow agitation shaft 30, engaged in said base plate 19, by a hose (not illustrated) from said slurry pump 13 is ejected and discharged through said holes 32 of said agitator impeller 31. A ground pressure detecting device is shown by 33 and is mounted at the tip end of said agitation impeller 31**.

As said shaft 24 is rotated by said motor 21, said pinions 26*a* and 26*b* rotate on said racks 27*a* and 27*b* in engagement therewith and elevate and lower said base plate 19 along said frames 18*a* and 18*b*, thereby changing the position of said agitator impeller 31 mounted at the lower end of said agitation shaft 30 in said weak soil layer. The elevation and lowering of said base plate 19 can be carried out within a certain range by changing the direction of rotation of said motor 21, upon sensing of ground pressure by said ground pressure detecting device 33. In this preferred embodiment, said ground pressure detecting device 33 is mounted at the tip of said agitator impeller. However, it will be easily understood by one skilled in the art that many kinds of pressure-detecting means can be employed instead thereof. For example, ground pressure can be also detected by change of torque in the driving mechanism which will be caused when said agitator shaft is lowered.

As shown, each agitating unit of said agitating means 11 embodying the present invention is constructed to be independently elevated and/or lowered. For example, when the contact of agitator impeller 31*a*, 31*b*, 31*c*, 31*d*, . . . of each agitating unit with the surface of bottom supporting foundation 1 is detected by said ground pressure detecting device 33, the other electric motor 28 begins to rotate said agitator impellers. A solidifier agent is at the same time ejected and discharged into the weak soil layer from said holes of the agitator impellers. When said agitator impeller reaches the surface of said bottom supporting foundation 1, said motor 21 begins to rotate in the reverse direction, and said agitator impellers are elevated one after another. Conversely, when said agitator impeller reaches a certainly predetermined height, it is again lowered. Said weak soil layer is thus continuously treated and stabilized up to a certain height from said bottom supporting foundation 1 and over a certain width and length by repeating the above operations together with moving said operation boat.

Since the lower ends of base plates 19 of each agitating unit which is herein elevated and lowered are not at a constant level due to differences of the supporting force of said bottom supporting foundation 1, it is preferred that the upper limits of movement of said base plates 19 are made constantly fixed, because said upper ends determine the upper surface of the ground to be treated and hardened.

The upper and lower limits of movements of said base plates 19 are controlled by changing the direction of revolution of said motor 21 in accordance with the value measured by said ground pressure detecting device and with torque change in the other means. There is a further simple means to control the upper limits of movements of said base plate 19, i.e. limit switches mounted at a fixed position on frames 18*a* and 18*b* along which said base plate 19 is elevated and lowered, thereby the upper limits of said base plate movement are effectively controlled when said base plate comes into contact with said limit switches when said base plate is elevated. The upper face of treated and stabilized ground will be formed at the same level by setting such limit switches to the same level position on frames 18*a* and 18*b* for each agitating unit. If necessary, level difference can be optionally obtained on the surface of treated and stabilized ground by suitably changing the position of said limit switches.

A suitable sructure and/or building is thus constructed directly or indirectly on said stabilized foundation. Since the detailed illustration showing the arrangement of the whole treatment equipment embodying the present invention is omitted herein, said agitating means 11 is mounted in such manner that said means 11 may be elevated and lowered by a certain fixed distance along said guide piller 15*a* and 15*b* by actuation of winch means 34. If said agitating means 11 is constructed in this manner, said agitating means 11 can be lowered as a whole together with lowering of said agitation shaft 30 when treating said weak soil layer, whereby weak soil layers deep under the water can be treated and stabilized without use of long agitation shafts, and the treatment equipment is then more compact in size.

Since agitation shafts which are independently elevated and lowered in accordance with the supporting force of bottom supporting foundation have been described in detail in the above preferred embodiment, there would be no problem even if agitation shafts, which are elevated and lowered all together, are employed in case the bottom supporting foundation is kept nearly level on its surface. Plural agitating units are provided in a line in this preferred example, but there could be a single agitator impeller 31 removably mounted at the tip of an agitation shaft 30 by a set screw 35. It is convenient that, if necessary, said agitator impeller may be replaceable by an agitator impeller having a different diameter.

In this preferred embodiment, one agitator impeller 31 is mounted at the lower end of said agitation shaft 30. However, several agitator impellers can be mounted on each agitation shaft with a suitable interval therebetween. It is preferred that agitator impellers are mounted on each two adjacent agitation shafts and are so arranged that they never occur on the same level, i.e. they are mounted in zigzag relationship in a vertical plane.

In this case where plural agitator impellers are provided in multiple stages at a certain interval in the axial direction of the agitation shaft 30, a certain depth of weak soil layer can be treated and stabilized at the same time. Therefore, the necessary stabilizing treatment can be carried out merely by moving said operation boat without elevation of said agitation shafts 30.

This treatment equipment may be either of independently running typewith self-driving means, or of the towing type e.g. towing means such as a winch, and hollow wheels can be employed instead of said floating means 10.

The solidifier agents to be employed for stabilizing treatment of said weak soil layer in the present invention are the castable compounds for soil hardening made by blending A-component 75 - 95% by weight with B-component 5 - 25% by weight, blended with industrial residue in proportions 40 - 60% by weight, such as calcium hydroxide, carbite residue, aluminium residue, nickel residue and mineral residue, silicic acid material 10 - 20% by weight, pulped residual lignin material 1 - 2% by weight, and Portland cement 5 - 40% by weight, all of which being obtained by heating at a temperature from 500° C to 1,000° C, after molding or forming it to be granular, if possible, the compound material having chloride 10 – 15% by weight (but as liquid of Baume 35° ), magnesium and/or calcium such as magnesium chloride and calcium chloride, fabric material powder 15 – 20% by weight such as wooden powder and/or pulp chips, and calcium hydroxide 65 – 80% by weight. These castable compounds for soil hardening are marketed commercially with the brand names "Chemicolime" and/or "Fujibeton."

If said solidifier agent is directly supplied to said agitator impellers by providng a slurry plant by which said solidifier agent is immediately turned into slurry and a sendin system by which said solidifier agent, necessary for stabilizing treatment, is distributed to said slurry pump on said operation boat, it is possible to effectively and efficiently put the stabilizing treatment into practice. However, it said weak soil layer exists directly under said treatment equipment, and if it is required to reduce and lighten the weight of said treatment equipment, it is recommended that said agitator 12 and other devices are separated and put on another floating means, or that such agitator 12 and devices are mounted on land and said solidifier agent is delivered through a long hose.

Figure 7A:
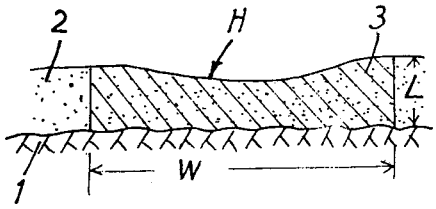
FIGS. 7A and 7B are cross sectional views showing one example of waterway constructed by a treatment equipment embodying the present invention.
Figure 7B:
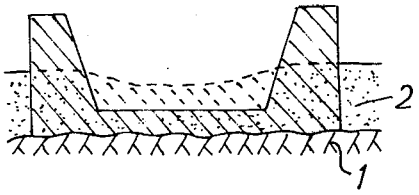

Examples of effectively and efficiently carrying out said methods embodying the present invention are described hereinafter:- FIG. 7 shows that a waterway is constructed in said weak soil layer by the treatment equipment embodying the present invention. Namely, as shown in FIG. A, said weak soil layer 2 existing on said bottom supporting foundation 1 is treated and stabilized in a certain width W and length L up to the surface H of said weak soil layer by said treatment equipment in order to obtain a stabilized foundation 3. Then, as shown in FIG. B, the central part of said stabilized foundation 3 is cut and removed, and is put on both sides of said stabilized foundation 3, thereby composing walls of a waterway.

Figure 8A:
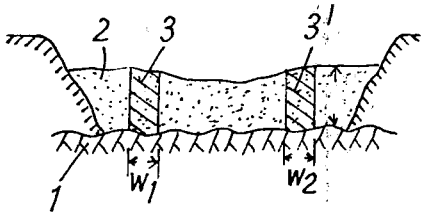
FIGS. 8A and 8B are cross sectional views showing one example of conservancy of river by a treatment equipment embodying the present invention.
Figure 8B:
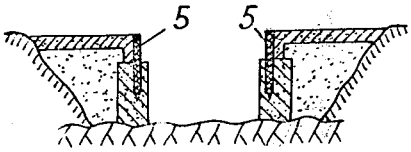

FIG. 8 shows one example of conservancy work on a river where weakk soil layer is heaped up on the bottom thereof. As shown in FIG. A, said weak soil layer 2 existing on said bottom supporting foundation 1 is partially treated for stabilizing up to the surface thereof at a certain width $W_1$ and $W_2$ adjacent to the banks of said river and along a certain length, thereby wall parts 3 and 3' treated for stabilization being obtained. Then, as shown in FIG. B, drive-in plates and/or piles 5 (hereinafter referred in as "drive-in plate") are driven into said wall parts 3 and 3', and said weak soil layer existing between said wall parts 3 and 3' is sucked up and deposited in the space produced between said drive-in plates and said banks. The surface of said weak soil layer sucked up in the above and the part existing at the rear-side of said drive-in plates and adjacent to said walls 3 and 3' are treated for stabilization in a necessary fixed thickness.

Figure 9A:
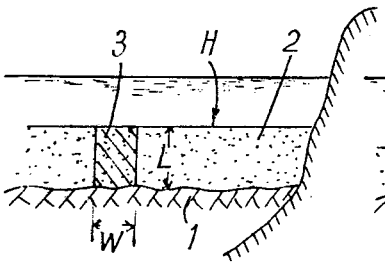
FIGS. 9A and 9B are cross sectional views of one example of reclamation and developing of a harbour by a treatment equipment embodying the present invention.
Figure 9B:
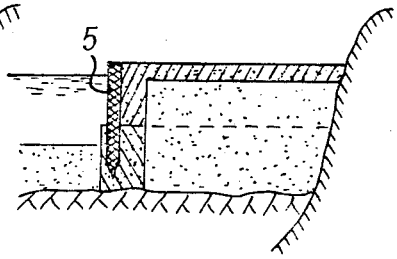

FIG. 9 shows on example of reclamation and developing work of harbour. As shown in FIG. A, said weak soil layer 2 distant from the shore and existing on said bottom supporting foundation 1 is partially treated for stabilization up to the surface H of said weak soil layer in a certain width W and length L, whereby a treated and stabilized wall 3 is obtained. Then, as shown in FIG. B, said drive-in plates 5 are driven into said wall 3 and said weak soil layer heaped up on the bottom is sucked up and deposited in the space produced between said drive-in plates and said shore. The surface of said weak soil layer sucked up in the above and the part thereof existing at the rear side of said drive-in plate 5 and adjacent to said wall 3 are treated for stabilization over a necessary fixed thickness, as in the former case. If the shore is high, it is recommended that the above work is repeated several times.

Figure 10:
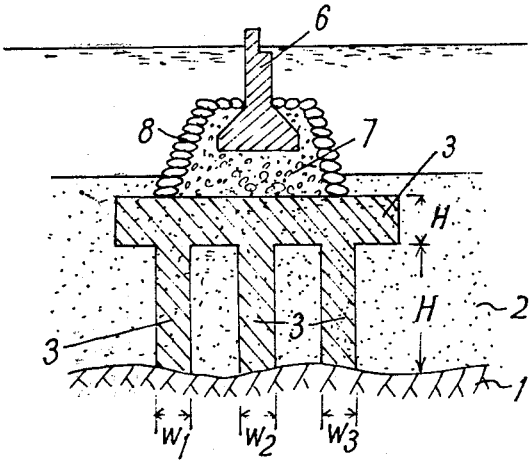
FIG. 10 is a cross sectional view showing one example of obtaining a stabilized foundation necessary for civil engineering construction in the sea by a treatment equipment embodying the present invention.

FIG. 10 shows an example of constructing stabilized ground necessary for civil construction work in the sea. Said weak soil layer 2 existing on said bottom supporting foundation 1 is treated for stabilization over a fixed width $W_1$, $W_2$, and $W_3$ up to a certain height $H_1$ under the surface of said weak soil layer, thereby composing wall 3 which is continuous in the length direction. Plural walls 3 (three walls in the illustration) are to be constructed by treating said weak soil layer for stabilization at suitable intervals. Said weak soil layer existing on said walls 3 is next treated for stabilization up to a certain height $H_2$ in such a manner that the treated and stabilized foundation may be totally or partially continued, thereby obtaining a stabilized and hardened foundation 3. The necessary structure is therefore suitably erected on said treated and stabilized foundation 3. In the illustration of FIG. 10, a break-water is built by providing a concrete bank 6. Foundation ripraps are shown at 7. 8 shows ripraps for base strengthening.

In the above example, since the walls 3 are arranged in a line, it is also preferred that walls are formed in parallel, or in crosses, and/or in any other suitable forms. It is further preferred that nets, mats, and/or sheets which are often used in the conventionally known methods are employed directly on said treated and stabilized foundation 3.

Figure 11:
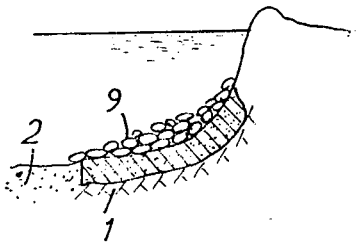
FIG. 11 is a cross sectional view of one example of arc slide prevention work in ponds and/or lakes by a treatment equipment disclosed by the present invention.

FIG. 11 shows an example of reinforcement work of a bank wall in a pond or lake where a weak soil layer is heaped up on the bottom. In this illustration, it is seen that said weak soil layer 2 heaped up on bank walls is totally treated for stabilization over a certain area on the bottom supporting foundation 1 in order to prevent sliding. Ripraps are herein shown at 9.

In the above examples, the bottom supporting foundation 1 does not necessarily need to be a rock foundation. For example, if a sand layer exists between it and the heaped weak soil layer 2 and if a stabilized foundation necessary for civil construction is obtained by treating said weak soil layer heaped up on said sand layer by a certain depth, said sand layer can be regarded as a bottom supporting foundation for stabilizing treatment. If this sand layer is not suitable for a bottom supporting foundation, another sand layer existing under said sand layer can be regarded as a bottom supporting foundation.

If a certain supporting force necessary for civil construction is obtained on a certain layer, said layer i.e. usually a silt-mixed sand layer is also regarded as a bottom supporting foundation.

We claim:

1. The method of treating a weak soil layer above a foundation layer, to form a stabilized mass based on said foundation layer and of predetermined height, width and length, which comprises the steps of:

i. agitating said weak soil layer by moving through it a plurality of rotating agitator impellers, arranged closely spaced in a row, the agitator impellers being reciprocated vertically and simultaneously translated horizontally through the weak soil layer in a direction transversely to the row, each agitator impeller being moved in its vertical movement independently of the other agitator impellers through a vertical stroke of which the lower end point is determined by contacting of the foundation layer by the respective agitator impeller, and of which the upper end point is predetermined as the upper boundary of the stabilized mass and is the same for all of the agitator impellers, and ii. injecting a solidifier agent from the rotating agitator impellers into the weak soil layer during the rotation and vertical and translatory movement of the agitator impellers.

* * * * *